US011832708B2

(12) United States Patent
Pocquet De Livonniere et al.

(10) Patent No.: US 11,832,708 B2
(45) Date of Patent: Dec. 5, 2023

(54) PACKAGING FOR COSMETIC PRODUCT SAMPLE HAVING AN APPLICATOR, AND COSMETIC PRODUCT SAMPLE HAVING AN APPLICATOR

(71) Applicant: LIVCER, Sucy-en-Brie (FR)

(72) Inventors: Charles Pocquet De Livonniere, Sucy-en-Brie (FR); Aude Pocquet De Livonniere, Sucy-en-Brie (FR)

(73) Assignee: LIVCER, Sucy-en-Brie (FR)

( * ) Notice: Subject to any disclaimer, the term of this patent is extended or adjusted under 35 U.S.C. 154(b) by 798 days.

(21) Appl. No.: 16/620,322

(22) PCT Filed: May 31, 2018

(86) PCT No.: PCT/FR2018/051252
§ 371 (c)(1),
(2) Date: Dec. 6, 2019

(87) PCT Pub. No.: WO2018/224752
PCT Pub. Date: Dec. 13, 2018

(65) Prior Publication Data

US 2021/0076800 A1 Mar. 18, 2021

(30) Foreign Application Priority Data

Jun. 7, 2017 (FR) ..... 1755057

(51) Int. Cl.
*A45D 40/00* (2006.01)
*A45D 40/26* (2006.01)
(Continued)

(52) U.S. Cl.
CPC ..... *A45D 40/0087* (2013.01); *A45D 40/262* (2013.01); *B65D 75/328* (2013.01);
(Continued)

(58) Field of Classification Search
CPC ..... B65D 75/328; B65D 2221/00; B65D 2575/3245; A45D 40/087; A45D 40/262;
(Continued)

(56) References Cited

U.S. PATENT DOCUMENTS 4,889,228 A * 12/1989 Gueret ..... A45D 34/046 206/823
5,660,273 A * 8/1997 Discko, Jr. ..... B65D 75/5855 206/229
(Continued)

FOREIGN PATENT DOCUMENTS

DE 299 04 857 U1 6/1999
EP 0 323 336 A1 7/1989
(Continued)

OTHER PUBLICATIONS

International Search Report for PCT/FR2018/051252, dated Jul. 16, 2018.

*Primary Examiner* — David J Walczak
(74) *Attorney, Agent, or Firm* — Sughrue Mion, PLLC

(57) ABSTRACT

A sample cosmetic product (1) having an applicator including a shell (7), incorporating a first portion (13) with a first cavity (10) and a second portion (15) with a second cavity (13) connected together so as to enable the reception of an applicator. A cover (8) is positioned on the shell to cover the first cavity and the second cavity, the cover welded around the first cavity on the first portion of the shell forming a first weld (26), and around the second cavity of the second portion of the shell forming a second weld (27). The first weld is configured to be dewelded by peeling away the cover to enable the opening of the first cavity. The packaging has a reinforcing mechanism separating the first portion and the second portion, the reinforcing mechanism is configured to prevent the dewelding of the second weld.

11 Claims, 5 Drawing Sheets

(51) Int. Cl.
*A45D 34/04* (2006.01)
*B65D 75/32* (2006.01)

(52) U.S. Cl.
CPC ..... *A45D 34/04* (2013.01); *B65D 2221/00* (2013.01); *B65D 2575/3245* (2013.01)

(58) Field of Classification Search
CPC .. A45D 34/042; A45D 34/043; A45D 40/264; A45D 34/045; A45D 40/265; A45D 34/046; A45D 40/267
USPC ..... 401/126–130, 132–135
See application file for complete search history.

(56) References Cited

U.S. PATENT DOCUMENTS

| | | | |
|---|---|---|---|
| 7,641,409 | B1 | 1/2010 | Wilde et al. |
| 2016/0249728 | A1 | 9/2016 | Hauger |

FOREIGN PATENT DOCUMENTS

| | | | |
|---|---|---|---|
| EP | 2 106 719 | A1 | 10/2009 |
| WO | 2010/018320 | A1 | 2/2010 |

* cited by examiner

FIG.6
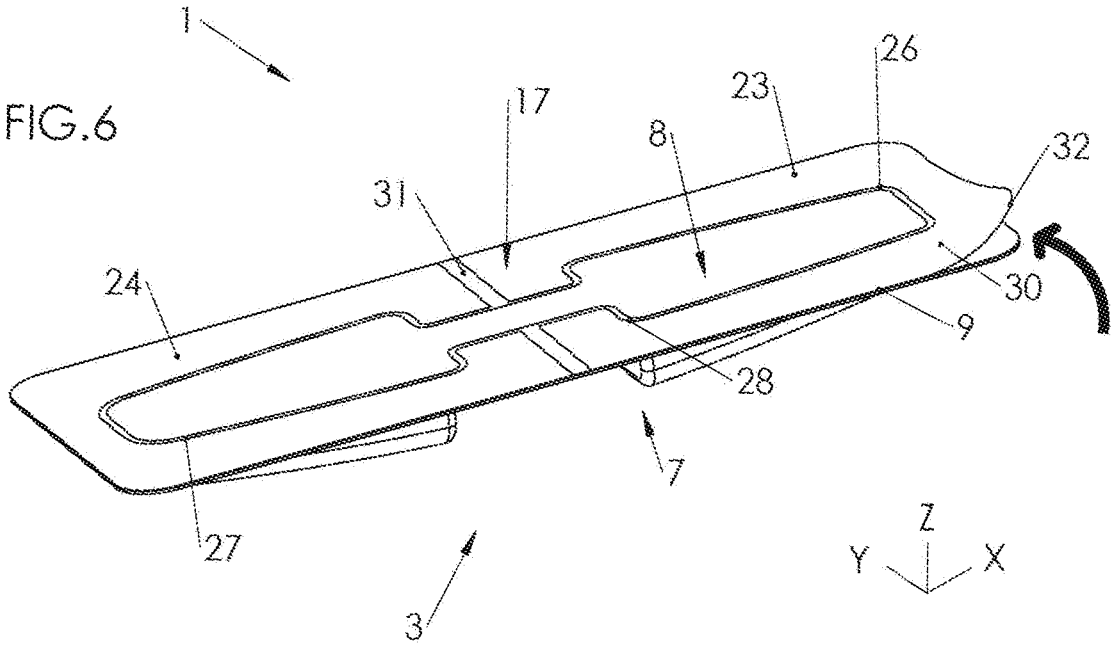
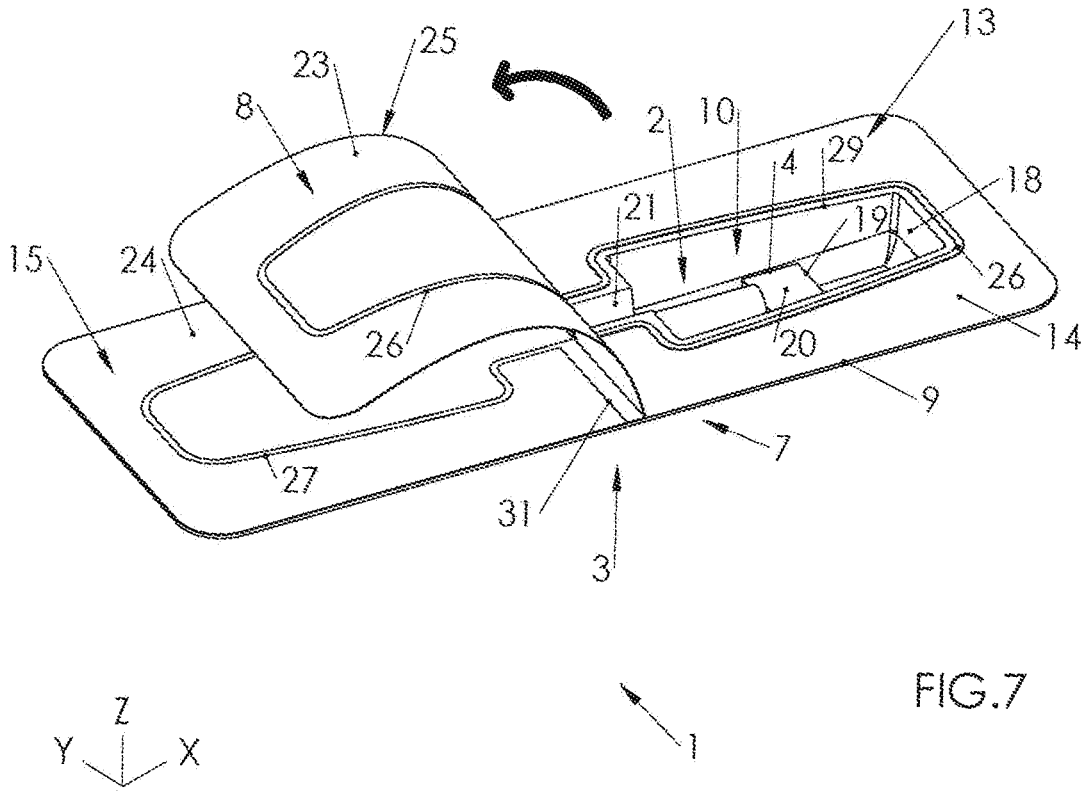
FIG.7

PACKAGING FOR COSMETIC PRODUCT SAMPLE HAVING AN APPLICATOR, AND COSMETIC PRODUCT SAMPLE HAVING AN APPLICATOR

CROSS REFERENCE TO RELATED APPLICATIONS

This application is a National Stage of International Application No. PCT/FR2018/051252 filed May 31, 2018, claiming priority based on French Patent Application No. 1755057 filed Jun. 7, 2017.

The invention relates to the field of packaging of products, cosmetic products in particular, and more particularly to single-use packaging intended for the packaging of cosmetic products having an applicator.

The term "cosmetic product" as used here designates any product as defined in EC Regulation No. 1223/2009 of the European Parliament and Council of Nov. 30, 2009 relative to cosmetic products.

"Cosmetic product having an applicator" as used here designates any cosmetic product being applied to the skin by means of an applicator comprising a gripping element enabling the applicator to be gripped.

The substance to be applied is a paste or powder, and in particular is a cosmetic substance such as mascara, gloss or eyeliner. The applicator can be different types of brush or a pencil.

In order to allow a cosmetic product to be tried out, it is known to package the products as samples or as single use products for sale. In this way, the possibility is offered of using the product hygienically, while allowing distributors and manufacturers of cosmetic products with applicator to minimize the quantity of product to be used.

The packaging of such samples or product sold, although for single use, should meet several strict criteria, including respect for the integrity of the cosmetic product from the time of manufacture to the time of use, compact in size and easy to use.

Such packaging also plays a role in the promotion of cosmetics, since they are used as marketing media in their own right.

Thus, for example, the samples are distributed in magazines, prospectuses, but can also be inserted, i.e. directly attached to cartons, generally on a flap, so as to showcase them.

The psychological dimension involved in the manipulation of such samples or product for sale is also important. In this respect, the opening of the packaging plays a particular role in the evaluation of the experience of use, and has an influence on purchasing.

Indeed, the opening of the packaging should be able to be done quickly, easily, without damaging the packaged product, and without causing any risk of injury to or soiling of the user.

Document WO 2010/018320 (Alcan Packaging Beauty Services) describes a single-use cosmetic product with applicator having an aspect identical to the original product, but in smaller dimensions. Such products are currently called "miniatures." The applicator end is for example a mascara brush such as a twisted wire brush, comprising a twisted metal wire in which a plurality of bristles are held, one end of the twisted metal wire core being attached in the rod; the applicator end can be that of the applicator distributor intended for sale corresponding to the sample.

Document U.S. Pat. No. 7,641,409 (ELC Management) proposes a disposable unit comprising a shell provided with a front wall, sealed to a rear wall by a lower joint and an upper joint, a peelable intermediate joint being provided so as to secure the opening. The upper joint can be peeled away with a tab, facilitating the opening of the disposable unit.

Although such a unit enables the use of an application element having characteristics substantially identical to that of a non-sampled applicator, the manipulation of such a disposable unit can present some difficulties. Indeed, the front and rear walls are produced from a flexible and elastic material, so that they cannot both be held open during extraction of the applicator. In order for the walls not to rub against the applicator, which could cause it to deteriorate, the user is required to hold the walls open in one hand while removing the applicator. Such manipulation requires a certain amount of dexterity for the user, in order not to stain the fingers. Furthermore, if the application part touches the user's fingers, there is a risk of contaminating the application part.

Document DE 29904857 U1 (Kocke) describes an applicator comprising a shell provided with a cover that can be peeled away by means of a tab. A perforation enables the cover to be made frangible when it is peeled above the grippable part of the applicator.

However, the perforations make the packaging fragile. If the sample undergoes pressure from another object, for example if it is placed in a pocket, it can be pierced causing a leak of the cosmetic substance. Moreover, purities, even microorganisms, can penetrate the cosmetic product. Such contamination could have serious consequences with respect to the health of the user, particularly for products intended to be applied near the eyes.

Document EP 2106719 (Socoplan) describes a packaging for a cosmetic product sample, this packaging comprising a line or a frangible or zone in a thermoformed shell. The use of a frangible zone leads to a risk of fluids entering and leaving, with loss of quality of the packaged product.

The invention seeks to remedy the aforementioned disadvantages with reference to the prior art.

An object of the invention is to propose a packaging for products, particularly cosmetic products having a sample applicator, said packaging being easily opened.

Another object of the invention is to propose such packaging, making it possible to ensure the integrity, particularly the microbial integrity, and to minimize the loss of moisture from the formula of a cosmetic product.

Another object of the invention is to propose such packaging, capable of being inserted.

Another object of the invention is to propose such packaging that is simple and economical to obtain.

Another object of the invention is to propose a sampled cosmetic product comprising a cosmetic product packaging having an applicator such as presented above.

To that end, firstly, a packaging is proposed of a sample or a single-use product for sale, particularly of cosmetic product having an applicator, said packaging comprising:

- a shell, incorporating a first portion, the first portion comprising a first cavity, and a second portion comprising a second cavity, the cavities being connected between them in such a way as to allow the reception of an applicator;
- a cover, positioned on the shell so as to cover the first cavity and the second cavity, the cover being welded around the first cavity on the first portion of the shell forming a first weld, and around the second cavity on the second portion of the shell forming a second weld, the first weld being intended to be dewelded by peeling away the cover in order to enable the first cavity to be opened, the packaging comprising a reinforcing means separating the first portion and the second portion, the reinforcing means being intended to prevent the dewelding of the second weld when the dewelding of the first weld occurs during the peeling away of the cover.

Such packaging, hermetically sealed, is then opened easily without the risk of staining the user's hands.

Various additional characteristics can be foreseen, alone or in combination:

- the reinforcing means comprises a weld bead obtained by welding, the weld bead being produced between the first portion and the second portion;
- the weld bead has a width greater than the width of the first weld;
- the cavities each comprise a periphery, the first weld and/or the second weld being made in the vicinity of the periphery;
- the first portion comprises a first border positioned around the first weld; the cover defines a free edge facing the first border;
- the second portion comprises a second border positioned around the second weld, the cover being sealed onto the second border;
- the first portion and the second portion are coplanar, so that the shell fitted with the cover has a flat surface;
- the packaging comprises an intermediate cavity between the first cavity and the second cavity, the intermediate cavity having a transverse dimension smaller than the transverse dimensions of the first cavity and the second cavity;
- the intermediate cavity comprises a neck, the neck extending so as to project into the intermediate cavity.

Secondly, a single-use cosmetic product is proposed comprising

- an applicator comprising a grippable element, and an application element, a cosmetic substance,
- packaging as presented above, the grippable element being positioned within the first cavity, the application element and the cosmetic substance being arranged within the second cavity.

Advantageously, the applicator is a mascara applicator, the cosmetic substance is mascara and the application element is a mascara brush.

Other characteristics and advantages of the invention will be seen more clearly and specifically from the following description of embodiments, which is provided with reference to the appended drawings in which:

FIG. 6 is a simplified view in perspective of a single-use cosmetic package, the cosmetic package being depicted in the process of being opened;

FIG. 7 is a simplified view in perspective of the single-use cosmetic package of FIG. 6, the cosmetic package being depicted in the process of being opened;

In the following description the terms "supple" or "flexible" are used to describe a material that is deformed through force exerted by a user, these terms not being synonymous with the term elastic.

Figure 1:
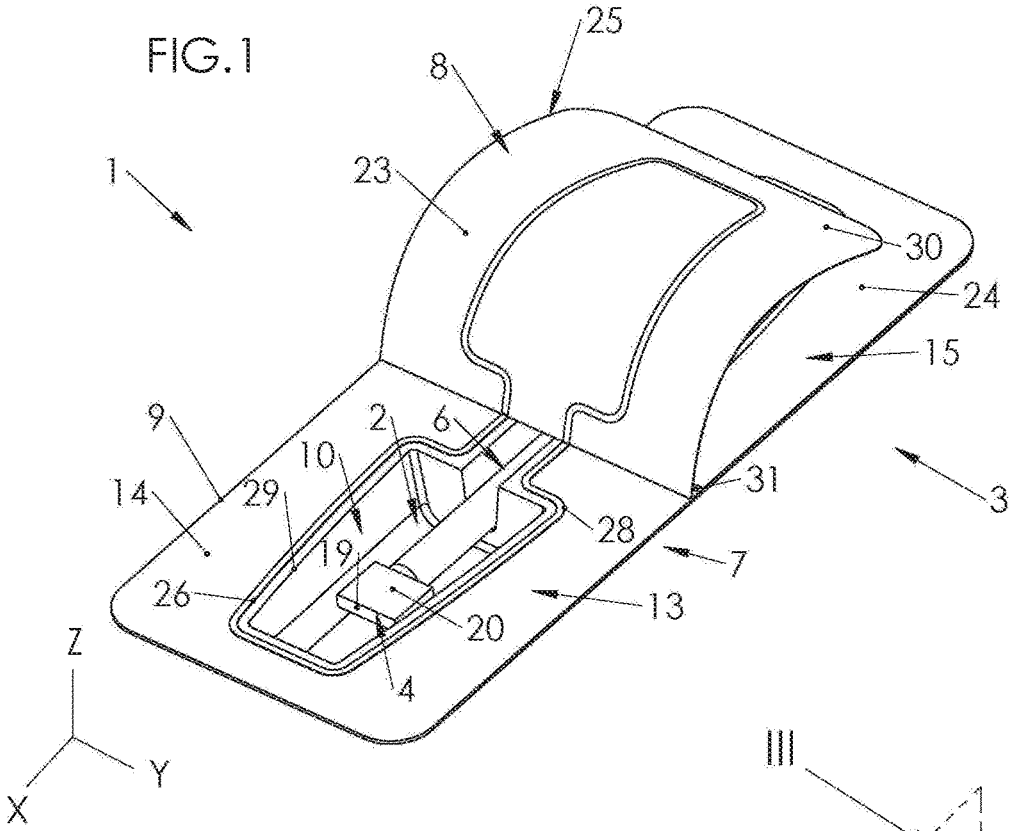
FIG. 1 is a simplified view in perspective of a sample cosmetic product, depicted in an open configuration.

FIG. 1 depicts a product sample having an applicator.

In the embodiments depicted, the product is a type of cosmetic.

The cosmetic product 1 comprises an applicator 2, a cosmetic substance (not represented) and peelable packaging 3.

The cosmetic substance is a liquid, paste or powder. For example, the cosmetic substance is a mascara.

The applicator 2 comprises a grippable element 4, connected to an application element 5 by means of an intermediate element 6.

The grippable element 4 enables the gripping of the applicator 2 by the user's fingers so that the application element 5 can be placed in contact with the skin of the user.

In a non-limiting manner, the sample cosmetic product 1 is a mascara and the application element 5 is a brush.

According to other embodiments not shown, the sample cosmetic product 1 is a rouge, an eyeshadow, a lipstick, a gloss, an eyeliner, or any other sample cosmetic product 1 comprising a cosmetic substance to be applied by means of an applicator.

As depicted in FIG. 1, the applicator 2 as well as the cosmetic substance are located within the packaging 3. In a closed configuration, illustrated in FIG. 2, the cosmetic substance as well as the applicator 2 are confined inside the packaging 3. The opening of the packaging 3 gives the user access to the grippable element 4 of the applicator 2. The packaging 3 is then in an open configuration, as depicted in FIG. 1.

In some implementations, the cosmetic substance is placed in the packaging 3, and the application element 5 is engaged in the cosmetic substance at the time the cosmetic product 1 is manufactured.

According to other embodiments, the applicator 2 is initially impregnated with cosmetic substance prior to being placed in the packaging 3.

Defined relative to the product packaging 1 is an orthogonal reference XYZ forming a direct trihedron, comprising three perpendicular axes two-by-two, namely:

- an X axis, defining a longitudinal direction, horizontal, coinciding with a general direction of extension of the grippable element 4 when the packaging 3 is in closed configuration;
- a Y axis, defining a transverse direction, horizontal, with which the X axis defines a horizontal XY plane;
- a Z axis, defining a vertical direction, perpendicular to the horizontal XY plane.

In the following description, and in relation to the reference defined above,

- the terms "longitudinal" or "longitudinally" refer to a direction coinciding with the X axis,
- the terms "transverse" or "transversely" refer to a direction coinciding with the Y axis,
- the terms "vertical" or "vertically" refer to a direction coinciding with the Z axis,
- terms of absolute position such as "front," "rear," "top," "down," "left," "right," or those that are relative such as "above," "upper," "beneath," "lower," are defined relative to the grippable element 4 of the applicator 2 within the packaging 3 in closed configuration, the positive direction of the X axis is defined by the normal direction of removal of the applicator 2 from the packaging 3.

According to the embodiments depicted, the packaging 3 comprises a shell 7 and a cover 8.

The cover 8 hermetically seals the shell 7. The separation of the cover 8 from the shell 7 is achieved by peeling away the cover 8, as explained further on in the description.

The packaging 3 has an outer contour 9 advantageously substantially rectangular so as to limit dropping and loss of material during the manufacture thereof.

In some implementations, the packaging 3 is obtained from methods using rectangular plates. In other implementations, the shell and the cover are obtained from spools.

Advantageously, the shell 7 has sufficient rigidity so that the manipulation thereof, for example during the opening of the packaging 3 by peeling away the cover 8, does not cause the deformation thereof.

The shell 7 is thus usable as support so that the user can pull the cover 8 and proceed with peeling it away. In this way the opening of the packaging 3 is simplified.

Moreover, the shell 7 offers protection against any possible impact, for example during transport of the packaging 3. The integrity of the cosmetic product 1 is respected, which minimizes the risk of leakage of the cosmetic substance or the entrance of impurities including germs into the packaging 3.

Figure 3:
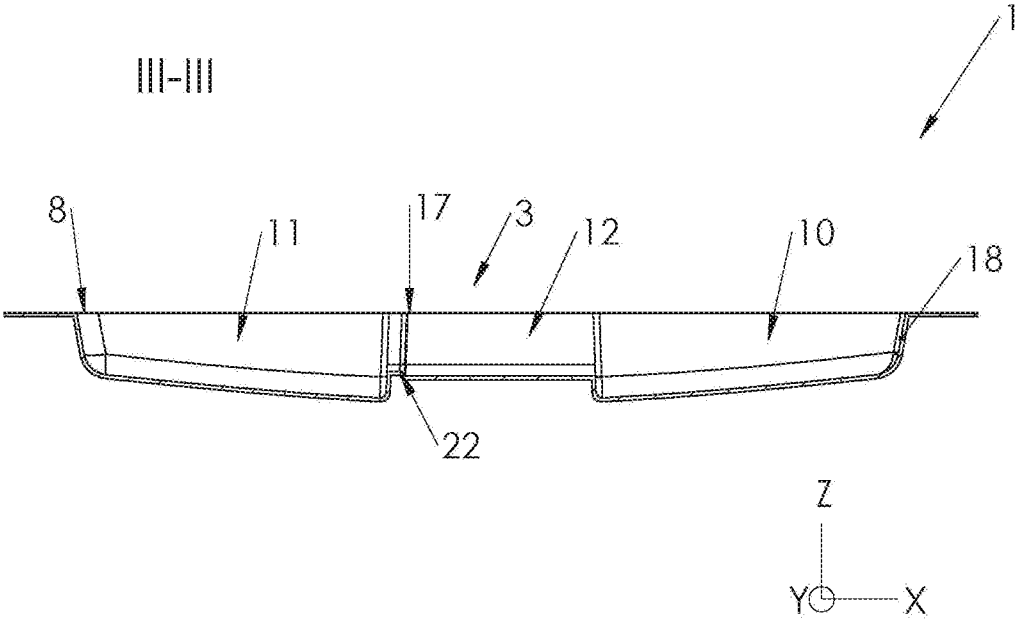
FIG. 3 is a simplified cross-sectional view of the sample cosmetic product, along line III-III of FIG. 2.
Figure 4:
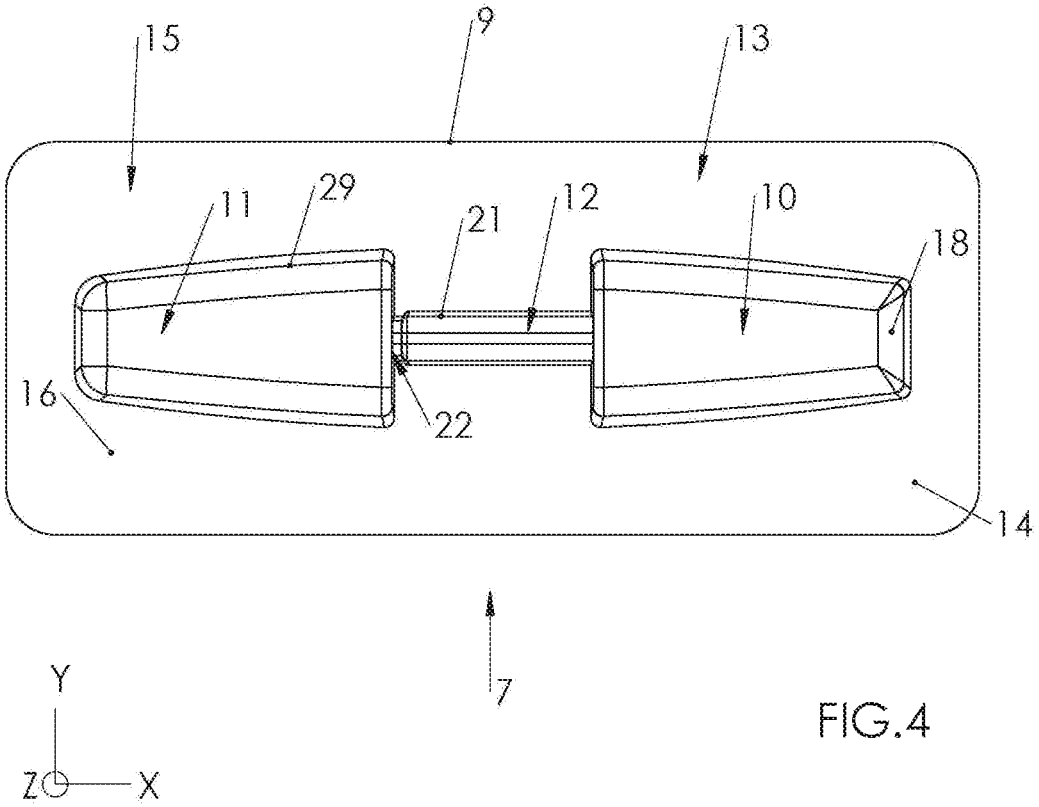
FIG. 4 is a simplified top view of the cosmetic packaging of FIG. 2.
Figure 5:
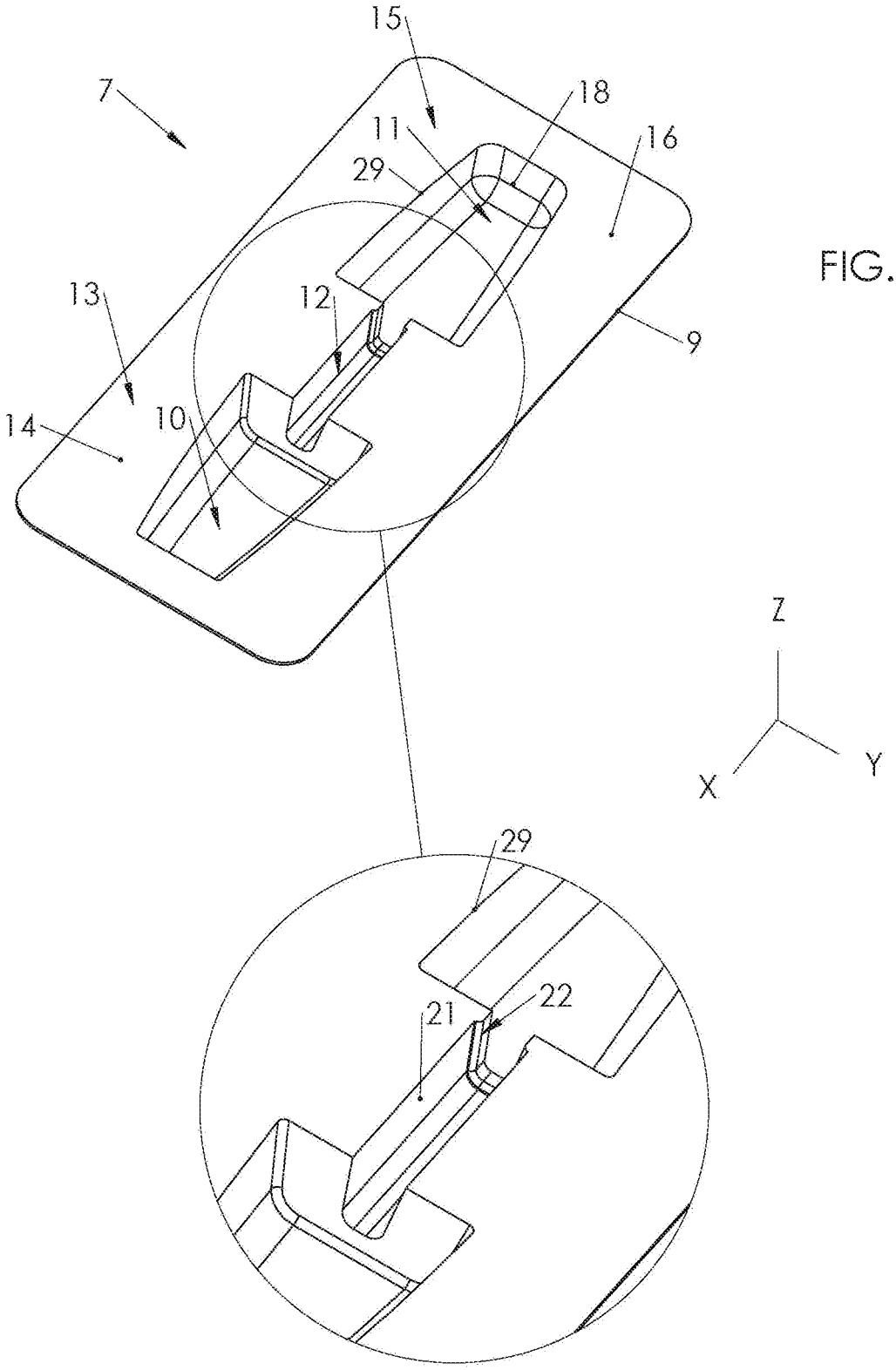
FIG. 5 is a simplified view in perspective of a cosmetic packaging of FIG. 2, with an inset detail view.

As depicted in FIGS. 3 to 5, the shell 7 comprises a first cavity 10 and a second cavity 11, both arranged in extension with one another, and connected with each other by an intermediate cavity 12.

Such arrangement enables an alignment of both the cavities 11, 12 in a substantially longitudinal direction, the shell 7 receiving an applicator 2 extending substantially longitudinally. In other embodiments, not shown, the cavities 11, 12 are not aligned along a substantially longitudinal direction, the mascara brush being curved.

The first cavity 10 is positioned inside a first portion 13 of the shell. The first cavity 10 is intended to house the grippable element 4 of the applicator. All around the first cavity 10, the first portion 13 has a first border 14.

The second cavity 11 is positioned within a second portion 15 of the shell. The second cavity 11 is intended to house the application element 5 of the applicator. All around the second cavity 11, the second portion 15 has a second border 16.

The intermediate cavity 12 extends between the first portion 13 and the second portion 15. The intermediate cavity 12 is surrounded by the first border 14 on the first portion 13, and by the second border 16 on the second portion 15. In other words, the intermediate cavity 12 comprises one part pertaining to the first portion 13, and another part pertaining to the second portion 15. In this way, the intermediate cavity 12 is capable of receiving the intermediate element 6 of the applicator.

According to the embodiment depicted, the first border 14 and the second border 16 are both coplanar. The packaging 3 thus has a flat surface 17 extending for example along a horizontal plane, the cover 8 being placed flat on the first border 14 and the second border 16. Such a characteristic facilitates the insertion and attachment of the packaging 3 in a card (not depicted in the figures).

According to the embodiment depicted, the first cavity 10 and the second cavity 11 are substantially symmetrical with each other.

According to the embodiment depicted, the first cavity 10 and the second cavity 11 each have a longitudinal section having a substantially trapezoidal geometry, while the intermediate cavity 12 has a rectangular longitudinal cross-section.

According to a variant of embodiment, not depicted, the first cavity 10 defines a substantially parallelepiped-shaped volume, which gives it a flat bottom.

Advantageously, the first cavity 10 has a vertical dimension complementary to the vertical dimension of the grippable element 4 when the applicator 2 is positioned in the packaging 3. In this way, the grippable element 4 cannot be moved downwards when it is placed in the packaging 3. The possibility of such movement, made inadvertently by the user, for example, could result in a tipping upwards of the applicator, around the intermediate element 6, which could push the application element 5 against the cover 8 and could damage it. Furthermore, the quantity of material used for the formation of the first cavity 10 is optimized, making it possible to limit costs.

As depicted in FIG. 1, the first cavity 10 comprises for example a clearance between a front wall 18 of the first cavity 10 and one end 19 of the grippable element 4, when the applicator 2 is positioned in the packaging 3. In this way, sufficient space is left to allow removal of the applicator 2 from the packaging 3 without coming into contact with a front wall 18 of the first cavity 10.

According to a variant of embodiment, not depicted, the end 19 of the grippable element 4 is located in the vicinity of the front wall 18 of the first cavity 10. A functional clearance is left. In such situation, it is advantageous to equip the applicator 2 with articulation, for example provided on the intermediate element 6. This allows rotation of the grippable element, creating an empty space and offering a path to allow the translation of the applicator 2 within the packaging 3.

Advantageously, the first cavity 10 has a transverse dimension allowing the passage of a thumb and index finger. Gripping the grippable element 4 is then facilitated, since maximum space is allowed to enable the insertion of two fingers into the first cavity 10.

Advantageously, an applicator 2 having a grippable element 4 is used, one end 19 whereof has a flat head 20. Gripping the applicator 2 with the thumb and index finger causes the flat head 20 rotate, which pivots the application element 5 in the cosmetic substance, thus ensuring a homogeneous distribution of the cosmetic substance all around the application element 5.

As depicted in FIGS. 3 and 5, the intermediate cavity 12 is less deep than the second cavity 11, in other words the intermediate cavity 12 has a vertical dimension smaller than the second cavity 11 vertical dimension. In this way, the applicator 2 rests on the intermediate element 6 within the intermediate cavity 12, without the risk of the application element 5 coming into contact with the wall of the second cavity 11.

As depicted in FIG. 5, the intermediate cavity 12 has a U-shaped transverse cross-section. In this way, when the packaging 3 is in open configuration, the intermediate cavity 12 located within the first portion 13 is uncovered. Removal of the intermediate element 6 of the applicator 2 is thus facilitated.

According to the embodiment depicted, the intermediate cavity 12 has a transverse dimension smaller than the transverse dimension of the application element 5. Such an arrangement proves particularly advantageous for pressing the application element 5 of the cosmetic product 1 against a lateral face 21 of the intermediate cavity 12, which ensures good distribution of the cosmetic substance over the entire application element 5.

As can be observed in the inset of FIG. 5, the intermediate cavity 12 comprises for example a lateral face 21 provided with a neck 22. Said neck 22 is extended, projecting towards the interior of the cavity, and thus creates a relief. When the applicator 2 is removed by the user, the application element 5 first makes a translational movement and rubs against the neck 22, causing pressure. A homogeneous distribution of the cosmetic substance is thus promoted, which limits the risk of a localized concentration of product on one portion of the application element, but also of having an excess of product on the application element 5. In this way, any excess is removed from the application element 5 such as a brush, the packaging 3 thus enabling tidy usage, avoiding the risk of soiling for the user.

According to one embodiment, not shown, the second cavity 11 has a vertical dimension complementary to the vertical dimension of the application element 5. In this way, the quantity of material is limited to what is strictly necessary. Moreover, such reduced space makes it possible to limit the empty space, and to optimize the quantity of cosmetic substance to be inserted into the second cavity 11.

Advantageously, the shell 7 is obtained by thermoforming a plate of thermoplastic material previously softened by heating. In this way, the shell 7 production can be done economically in small quantities as well as in large quantities. Furthermore, the design of specific tooling being relatively easy and at reduced cost compared to other known methods, modification of the geometry of the shell, in particular the cavities, can be done quickly, which is advantageous for allowing for the peculiarities of each cosmetic product 1, and enables a multitude of different shell 7 geometries to be obtained.

Figure 2:
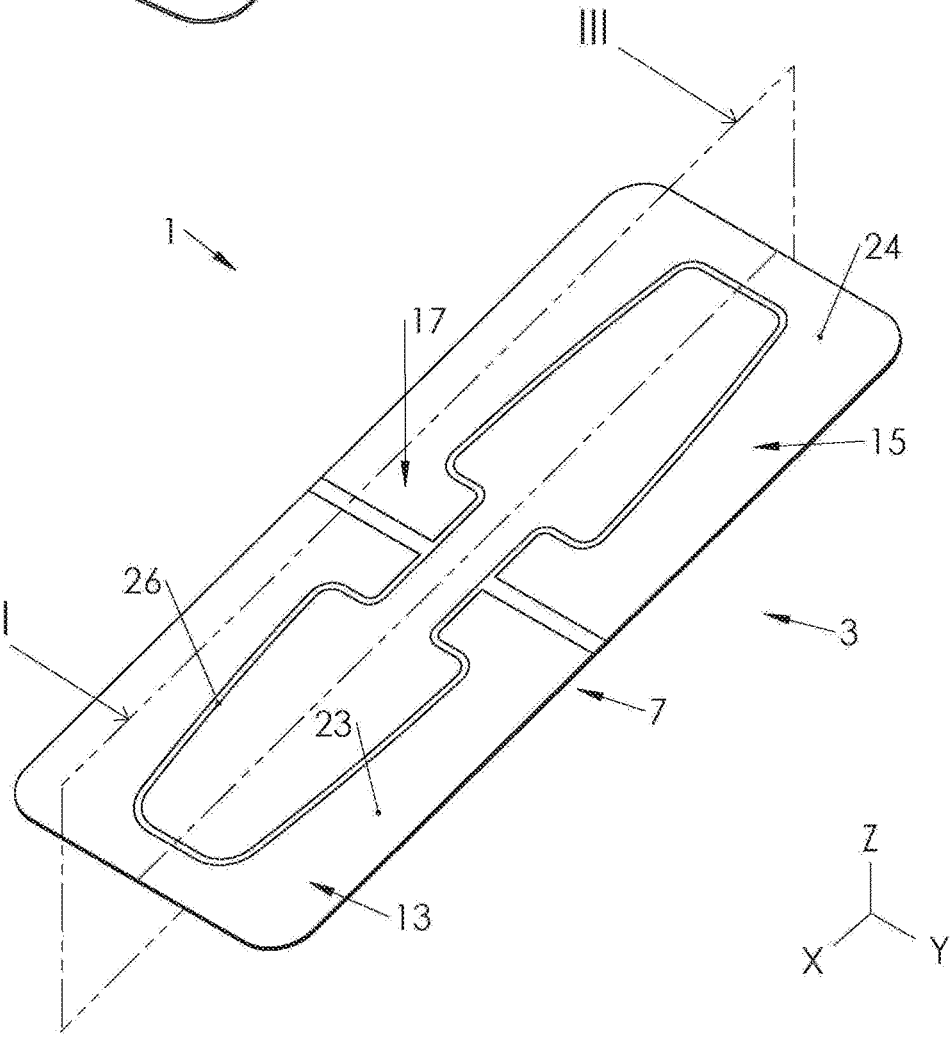
FIG. 2 is a simplified view in perspective of the sample cosmetic product of FIG. 1, depicted in a closed configuration.

As illustrated in FIGS. 2, 3 and 6, the packaging 3 is provided with a cover 8, the packaging 3 being depicted in closed configuration. In such a configuration, both the cavities are hermetically sealed in order to avoid any penetration of impurities or germs into the packaging 3, and to limit any risk of leakage of cosmetic product 1.

The cover 8 is for example produced from a material comprising aluminum and at least one thermoplastic film. The cover 8 thus offers sufficient resistance to allow peeling away without tearing, and to ensure confinement of the cosmetic product 1 and applicator. In this way, the integrity of the cosmetic product 1 is respected, also avoiding any microbial pollution once the packaging 3 is in closed configuration.

The cover 8 comprises a peelable section 23, covering the first portion 13, in particular the first cavity 10, and a non-peelable section 24 covering the second portion 15, in particular the second cavity 11. In this way, the opening of the packaging 3 is achieved by peeling away the peelable section 23 of the cover 8.

The cover 8 advantageously has a periphery 25 identical to the contour 9 of the shell, so as to be conformed to the shell.

In order to ensure the seal, the cover 8 is welded around the cavities, i.e. around the first cavity 10 on the first portion 13 of the shell 7 by forming a first weld 26, and around the second portion 15 by forming a second weld 27.

The expression "welded cover" is used here to designate the fact that the cover is sealed onto the shell, for example by hot welding, high-frequency welding, ultrasound welding, gluing.

Ultrasound welding provides high pressure and high heat onto a very small surface, enabling a localized definitive weld to be produced.

In one implementation, a weak weld 26 of two layers of peelable material produces a surface adhesion between said two layers in order to form the peelable section 23, while a strong weld 27 of said same two layers results in the mixture of these layers causing them to lose their peelable nature, in order to form the non-peelable section 24 of the cover. In one implementation, the pressure threshold or the amount of heat provided during welding of the cover onto the shell are [sic] different between the peelable section 23 and the non-peelable section 24, a weak weld 26 being obtained by applying less pressure and heat than for a strong weld 27.

The cover and the shell are advantageously produced from a multilayer material. In said multilayer, a barrier material such as aluminum makes it possible to avoid loss of product by migration through the packaging. In some implementations, a non-metallic layer is in contact with the cosmetic product, and an exterior layer is formed from one or more fused layers of thermoplastic material such as vinyl polymers, polyester, polyolefins, polyamides.

The welds 26 are produced in such a way that they can be dewelded, for example by pulling in a vertical direction. The welds 26 have dimensions enabling them to be dewelded by a predefined force, corresponding to an force exerted by a user to peel away the cover 8. Ideally, such force is a compromise: a weld of excessive resistance results in preventing the opening, the cover 8 yielding before the weld, while a weld that is not resistant enough offers insufficient security of confinement.

Advantageously, the angles of the welds 26 form curves 28, in order to avoid any concentration of stress during peeling away of the cover 8. Such a concentration of stresses would create blockages at the opening, requiring the user to force the opening, causing a tearing of the cover 8.

Advantageously, the first weld 26 is made near the periphery 29 of the first cavity 10. The first weld 26 then has a shape substantially identical to that of the periphery 29. In this way, maximum space is left between the contour 9 of the shell 7 and the first weld 26, the peelable section 23 of the cover 8 defining a free edge 30. Such free edge 30 of the cover 8 faces the first border 14 when the packaging 3 is in closed configuration. The free edge 30 can then be grasped by the thumb and index finger of a user, which gives the user increased gripping force and thus simplifies the peeling of the peelable section 23 of the cover 8. The first cavity 10 is then opened by dewelding the first weld 26.

Advantageously, a second weld 27 is made near the periphery 29 of the second cavity 11. The second weld 27 then has a shape substantially identical to that of the periphery 29. In this way, the second weld 27 is made farthest away from the contour 9, which enables it to be secured from any undesired peeling.

The packaging 3 further comprises a reinforcing means, for example a weld bead 31, separating the first portion 13 from the second portion 15. The weld bead 31 is positioned between the first portion 13 and the second portion 15. Such weld bead 31 prevents a dewelding of the first weld 26 from causing a dewelding of the second weld 27 during the peeling away of the cover 8. Indeed, by pulling on the free edge 30, the peelable section 23 is dissociated from the shell, causing the dewelding of the first weld 26; the weld bead 31 then blocks the advance of the cover 8. The peeling of the cover 8 is stopped at the peelable section 23. The non-peelable section 24, in contact with the cosmetic substance, cannot be opened. Thus, contact is avoided between the user's fingers and the cosmetic substance.

According to the embodiment depicted, the weld bead 31 is positioned perpendicular to the direction of detachment of the cover 8, and is interposed between the first portion 13 and the second portion 15.

For example, the weld bead 31 extends along a substantially transverse direction if the peeling is done along a substantially longitudinal direction. In this way, the resistance to removal of the cover 8 is maximal, and a veritable blocking during peeling of the peelable section 23 is created.

Advantageously, the weld bead 31 has a width greater than the first and second welds 26, 27. The weld bead 31 is thus more resistant to removal than the first and second welds 26, 27. The blocking of the peeling of the cover 8 once the open configuration is reached is thus reinforced.

Advantageously, the free edge of the non-peelable section 24 is sealed onto the second border 16. In this way, the user is prevented from wanting to peel away the non-peelable fraction 24.

Moreover, such a sealing also makes it possible to instantly distinguish the non-peelable section 24 from the peelable section 23. Such aspects are advantageous in order to facilitate the use of the packaging 3. Such sealing also enables the second weld 27 to be protected. The risk of deterioration of the second weld 27, detrimental to the seal of the second cavity 11, is limited. The seal of the non-peelable fraction 24 thus reinforces the security of the packaging 3.

The packaging 3 is opened by the user, and the applicator 2 is removed from the packaging 3, for example in the following manner.

The user holds the shell 7 with one hand. With the thumb and index finger of the other hand, the user pinches the free border 30, advantageously on a corner of the packaging 3, which forms a tab 32, as depicted in FIG. 6.

The user pulls the tab 32 upwards, then towards the second cavity 11, which causes the dewelding of the first weld 26. The peelable section 23 is peeled away until reaching the weld bead 31, as illustrated in FIG. 7. It is then no longer possible to continue peeling the cover 8, the weld bead 31 exerting a stopping effort to prevent any dewelding of the non-peelable portion.

With the other hand, the user holds the cover 8 open against the non-peelable section 24 with the index finger, while exerting a grip on the shell 7 with the thumb and middle finger. The user's hand relaxes the grip on the shell 7, grips the flat head of the applicator 2, and turns it along a longitudinal axis in order to obtain a sufficient grip to enable the gripping of the grippable element.

Figure 8:
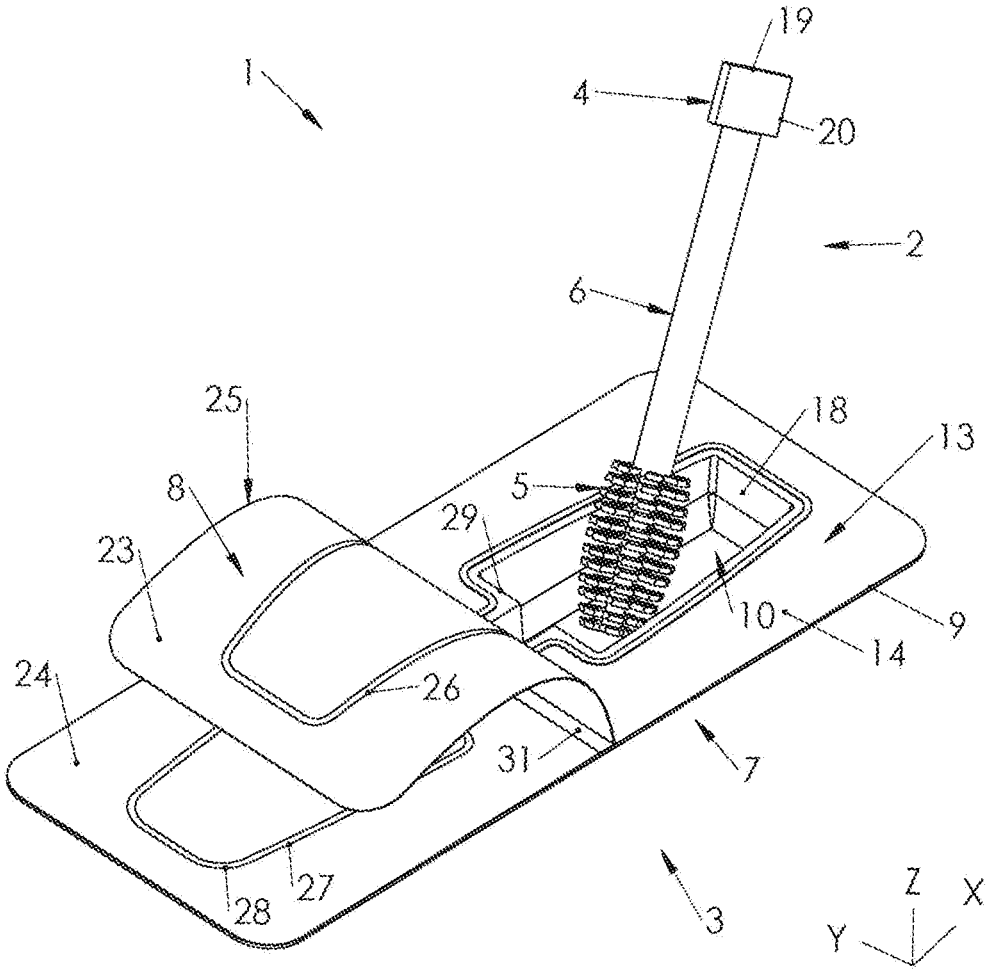
FIG. 8 is a simplified view in perspective of the single-use cosmetic package in FIGS. 6 and 7, the cosmetic package being depicted in open configuration, an applicator being removed.

As illustrated in FIG. 8, once the applicator 2 is pivoted, the user exerts a combined longitudinal translational movement and transverse rotational movement on the applicator 2 so as to remove it from the packaging 3.

As a result of such opening, the application element 5 has little risk of rubbing against the peelable fraction 23, or of touching the user's fingers.

The risks of contamination of the applicator 2 are reduced, as is the possibility that the user's fingers would become soiled by the cosmetic substance.

The packaging that has been described finds advantageous application in producing samples of cosmetic, hygiene and healthcare products, or medications.

The product to be applied is small in quantity, for example on the order of 0.1 to more than 10 mL and in particular on the order of 1 mL. The small quantity of product corresponds to an appropriate dose for one application or a single use for functional or aesthetic purposes.

In the implementations depicted, a single product, particularly cosmetic, is packaged. It is understood that two or more products can be positioned each in a reservoir formed in the shell, each product being linked to an applicator.

The single-use cosmetic product packaging 1 in particular has the following advantages:

- protection [of] the applicator and the product from external forces during transport, storage or insertion, the thermoformed shell having an overall rigidity;
- opening of the packaging by removal of the cover 8, without bending or torsional stress on the packaging, the applicator being thus protected from any risk of deterioration or breakage during the opening of the packaging;
- dosing of the product during passage of the applicator through the intermediate conduit, the opening of passage from the intermediate cavity 12 allowing the applicator to slide through the passage during the extraction thereof, rubbing against the walls of the intermediate cavity 12, the neck 22 ensuring removal of excess and distribution of the product on the applicator, and preventing risks of product spraying during removal of the applicator;
- maintaining a seal for the reservoir containing the product, before the first opening, the packaging not including a frangible zone and the material forming the cover and the shell being advantageously multilayered, a barrier layer such as aluminum limiting the risks of diffusion of chemical species through the packaging;
- intuitive use, the flat face of the packaging also allowing the printing of pictograms;
- adaptability to numerous types of cosmetic products comprising an applicator 2 and a product 1 to be applied;
- quick and easy to use for the user, who does not risk becoming soiled during use when opening the cover 8, and in removing an applicator 2 positioned within the packaging;
- respect for hygiene within the packaging due to an optimal seal.

The invention claimed is:

1. A packaging for a cosmetic product sample, comprising:

- a shell, incorporating a first portion, the first portion comprising a first cavity, and a second portion comprising a second cavity, the cavities being connected together so as to enable the reception of an applicator,
- a cover positioned on the shell so as to cover the first cavity and the second cavity, the cover being welded around the first cavity on the first portion of the shell forming a first weld, and around the second cavity of the second portion of the shell forming a second weld, the first weld configured to be dewelded by peeling away the cover in order to enable the opening of the first cavity,
- reinforcing means separating the first portion and the second portion, the reinforcing means configured to prevent the dewelding of the second weld when the dewelding of the first weld takes place during the peeling away of the cover.

2. The packaging according to claim 1, wherein the reinforcing means comprises a weld bead obtained by welding, the weld bead being produced between the first portion and the second portion.

3. The packaging according to claim 2, the adhesion due to the weld bead is stronger than adhesion due to the first weld and the second weld.

4. The packaging according to claim 2, wherein the weld bead is positioned perpendicular to a direction of detachment of the cover and is interposed between the first portion and the second portion.

5. The packaging according to claim 1, wherein the first portion comprises a first border positioned around the first weld, the cover defines a free edge facing the first border.

6. The packaging according to claim 1, wherein the second portion comprises a second border positioned around the second weld, the cover being sealed onto the second border.

7. The packaging according to claim 1, wherein the first portion and the second portion are coplanar, in such a way that the shell provided with the cover has a flat surface.

8. The packaging according to claim 1, comprising an intermediate cavity between the first cavity and the second cavity, the intermediate cavity having a transverse dimension taken in a direction orthogonal to a longitudinal direction of the packaging that is smaller than transverse dimensions of the first cavity and the second cavity taken in a directions orthogonal to the longitudinal direction of the packaging.

9. The packaging according to claim 8, wherein the intermediate cavity comprises a neck, the neck extending so as to project into the intermediate cavity.

10. A sample cosmetic product comprising:

an applicator, comprising a grippable element, and an application element, a cosmetic substance, packaging according to claim 1, wherein the grippable element is positioned within the first cavity, the application element and the cosmetic substance being arranged within the second cavity.

11. A sample cosmetic product having an applicator according to claim 10, wherein the applicator is a mascara applicator, the cosmetic substance is mascara and the application element is a mascara brush.

* * * * *